US009085163B2

(12) United States Patent
Sunouchi et al.

(10) Patent No.: US 9,085,163 B2
(45) Date of Patent: Jul. 21, 2015

(54) INKJET PRINTING APPARATUS AND METHOD FOR DISCHARGING SHIPPING INK

(71) Applicant: CANON KABUSHIKI KAISHA, Tokyo (JP)

(72) Inventors: Shunya Sunouchi, Machida (JP); Seiji Suzuki, Ebina (JP); Takaya Sato, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 145 days.

(21) Appl. No.: 13/651,713

(22) Filed: Oct. 15, 2012

(65) Prior Publication Data

US 2013/0100205 A1 Apr. 25, 2013

(30) Foreign Application Priority Data

Oct. 21, 2011 (JP) ..... 2011-231276

(51) Int. Cl.

| | |
|---|---|
| ***B41J 2/165*** | (2006.01) |
| ***B41J 2/175*** | (2006.01) |
| ***B41J 2/185*** | (2006.01) |
| ***B41J 29/02*** | (2006.01) |

(52) U.S. Cl.

CPC *B41J 2/175* (2013.01); *B41J 2/185* (2013.01); *B41J 29/02* (2013.01)

(58) Field of Classification Search

None

See application file for complete search history.

(56) References Cited

U.S. PATENT DOCUMENTS

| | | | | |
|---|---|---|---|---|
| 5,980,021 | A | 11/1999 | Nagoshi et al. | |
| 6,149,261 | A | 11/2000 | Kuwabara et al. | |
| 6,302,516 | B1 | 10/2001 | Brooks et al. | |
| 6,491,365 | B2 * | 12/2002 | Sonobe | 347/22 |
| 6,719,400 | B2 | 4/2004 | Inui et al. | |
| 8,061,805 | B2 | 11/2011 | Suzuki et al. | |
| 2004/0137159 | A1 | 7/2004 | Nakamura et al. | |
| 2010/0033531 | A1 | 2/2010 | Suzuki et al. | |
| 2010/0321425 | A1 * | 12/2010 | Kanke et al. | 347/6 |

FOREIGN PATENT DOCUMENTS

| | | | |
|---|---|---|---|
| CN | 1214012 | A | 4/1999 |
| CN | 1498688 | A | 5/2004 |
| EP | 1025997 | A2 | 8/2000 |
| JP | 05-169676 | A | 9/1993 |
| WO | 2009/049135 | A1 | 4/2009 |

OTHER PUBLICATIONS

May 5, 2014 Chinese Office Action in Chinese Patent Application No. 201210404580.1.

* cited by examiner

*Primary Examiner* — Alejandro Valencia

(74) *Attorney, Agent, or Firm* — Fitzpatrick, Cella, Harper & Scinto

(57) ABSTRACT

The method of this invention for discharging a shipping ink from a newly installed print head filled with that ink minimizes the amount of shipping ink that may remain in the print head after the ink discharging process is performed. The shipping ink discharging method according to this invention comprises: a print head; an ink tank; a first pump; a second pump; a switch valve; and a cleaning mechanism; wherein the switch valve is closed and the first pump is operated to discharge the shipping ink from the ink ejection nozzles and the cleaning mechanism is operated to clean the print head, after which the switch valve is opened and the second pump is operated to supply ink from the ink tank to the print head.

5 Claims, 12 Drawing Sheets

INKJET PRINTING APPARATUS AND METHOD FOR DISCHARGING SHIPPING INK

BACKGROUND OF THE INVENTION

1. Field of the Invention

The present invention relates to an inkjet printing apparatus and a method of discharging a shipping ink and more particularly to an inkjet printing apparatus and a shipping ink discharging method which discharges the shipping ink from a print head filled with that ink.

2. Description of the Related Art

If, during a long period of storage or during shipping, a print head of an inkjet printing apparatus is left not filled with ink, a film of contaminants coming from surrounding environment may be formed over the surface of heaters in the print head. When in use, such a print head is likely to exhibit deteriorated bubble formation characteristics and therefore a degraded print quality. To prevent such a degradation in the bubble formation performance, a technique has been known to fill the print head with a shipping ink which is a printing ink cleared of coloring components and is used during storage and shipping.

When a print head filled with a shipping ink is used in a printing apparatus for a printing purpose, the print head, before starting a printing operation, undergoes a conventional shipping ink discharging process known as an ageing processing technique (e.g., Japanese Patent Laid-Open No. H05-169676 (1993)). The ageing processing technique involves applying heat pulses successively to heaters of the print head to separate and remove an oxide film and impurities deposited on the heaters, then installing the print head in the printing apparatus, discharging the shipping ink from the nozzles and filling the print head with a printing ink from an ink tank for the printing operation.

However, in a line type print head that is used in printing laboratories where large volumes of prints are processed, the use of the above ageing processing technique in discharging the shipping ink may result in significant amount of the shipping ink remaining in the print head. This is because the line type print head has many nozzles and long flow path connecting these nozzles and therefore a correspondingly large volume of shipping ink required to fill them.

Moreover, simply discharging the shipping ink with a bubble formation energy alone, that is, by means of ink ejection through nozzles activation alone, leaves a significant amount of the shipping ink, that was loaded into the flow path in the print head, undischarged, though the shipping ink in the liquid chamber in the print head can be expelled.

Further, in an inkjet printing apparatus that performs an ink circulation operation through the line type print head, if a shipping ink remains in the print head, it may during the ink circulation operation be mixed with a printing ink present in the printing apparatus body. If an ink mixed with the shipping ink is used for printing on a print medium, it may take long before the printed color or hue becomes stabilized.

SUMMARY OF THE INVENTION

The present invention has been accomplished to provide an inkjet printing apparatus and a shipping ink discharging method which can minimize an amount of the shipping ink that may remain in a print head after the ink-filled print head has been discharged of the shipping ink.

To achieve this objective, the inkjet printing apparatus of this invention comprises: a print head having arrays of ink ejection nozzles formed therein, the print head being filled with a shipping ink; an ink tank accommodating ink to be supplied to the print head; a first pump installed in an ink supply path to deliver ink from the ink tank to the print head; a second pump installed in an ink recovery path to collect ink not ejected from the print head into the ink tank; a switch valve installed between the print head and the second pump; and a cleaning mechanism movable toward the nozzle arrays to clean the print head; wherein the switch valve is closed and the first pump is operated to discharge the shipping ink from the ink ejection nozzles and the cleaning mechanism is operated to clean the print head, after which the switch valve is opened and the second pump is operated to supply ink from the ink tank to the print head.

In the inkjet printing apparatus of the above construction, the shipping ink filled in a print head is expelled from the head in the following procedure: the interior of the print head is depressurized to suck the shipping ink out of the print head into a drain tank; and then the interior of the print head is pressurized to force out the shipping ink remaining in the print head, after which a nozzle-formed surface of the print head is cleaned by a maintenance operation. This process can minimize the amount of shipping ink remaining in the print head after the print head has been discharged of the ink.

Further features of the present invention will become apparent from the following description of exemplary embodiments with reference to the attached drawings.

DESCRIPTION OF THE EMBODIMENTS

One embodiment of this invention will be described in detail by referring to the accompanying drawings.

Figure 1:
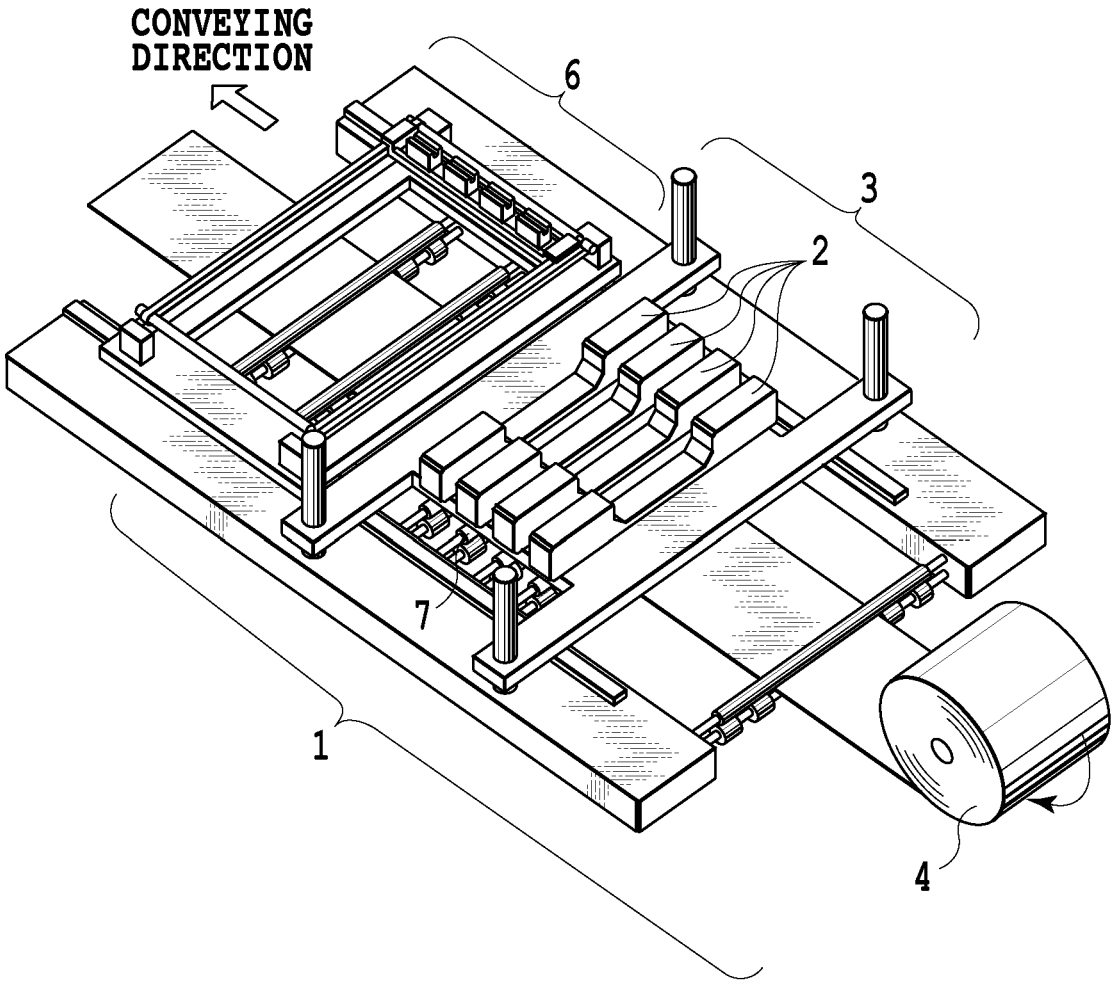
FIG. 1 is a schematic perspective view of an inkjet printing apparatus as one embodiment of this invention while in a printing operation.

FIG. 1 is a schematic perspective view of an inkjet printing apparatus as one embodiment of this invention when it is in a state of printing operation. The printing apparatus of this embodiment is a high-speed, inkjet line printing apparatus that uses a rolled continuous print medium and can perform both a one-side and a two-side printing operation on the print medium. This printing apparatus is well suited to applications where large volumes of printing are done, as in printing laboratories.

A printing apparatus 1 has a printing unit 3 made up of a plurality of print heads 2 and ejects drops of ink from the print heads 2 onto a print medium 4 to form an image on it. The printing unit 3 comprises four print heads, each accommodating one of four CMYK inks. The present invention is not limited to this configuration. For example, the printing unit 3 may consist of any desired number of print heads so that three color inks or five or more color inks can be used. Furthermore, the printing unit 3 may be constructed of a single print head incorporating a plurality of color ink tanks.

The print heads 2 are held together by a head holder 5 which can be moved vertically to change the distance between the printing unit 3 and a print surface of the print medium. At a most upstream position in the printing apparatus 1 is located a paper feeding unit (not shown) in which a paper feeding/conveyance mechanism (not shown) including conveyance rollers 7 is installed to feed the print medium 4 to the print heads 2 and, during a printing operation, advance it at a constant speed. The print medium 4 used in the printing apparatus of this invention is not limited to a rolled continuous print medium but may be cut sheets.

Figure 2:
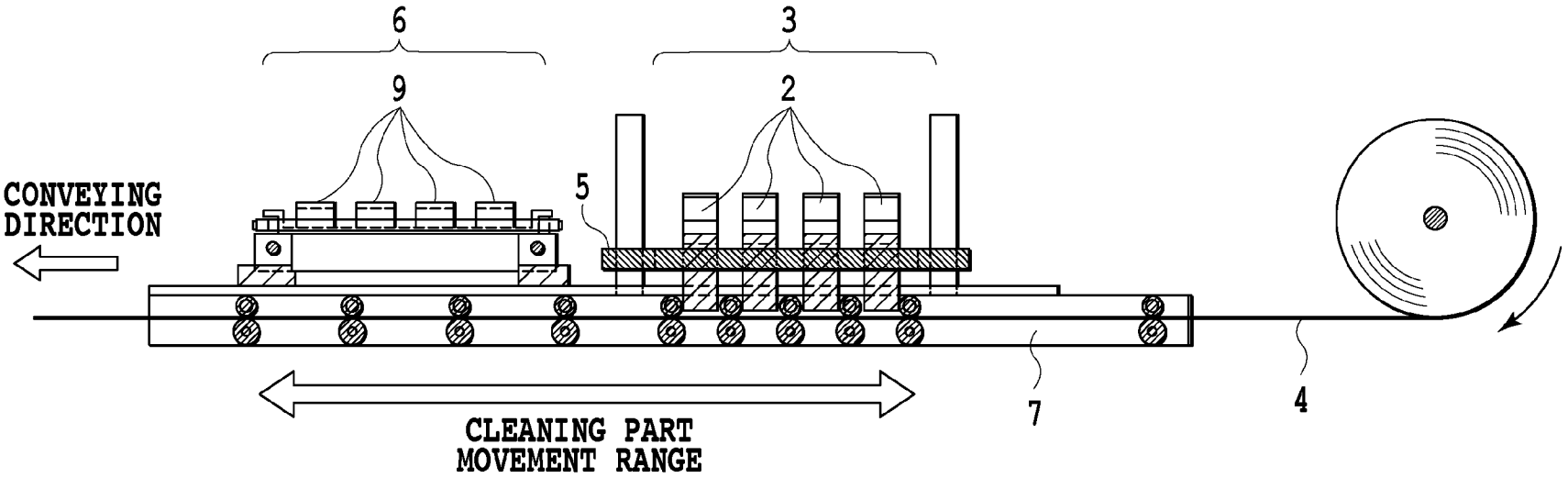
FIG. 2 is a schematic cross-sectional view showing a cross-sectional construction of the printing apparatus of FIG. 1.
Figure 3:
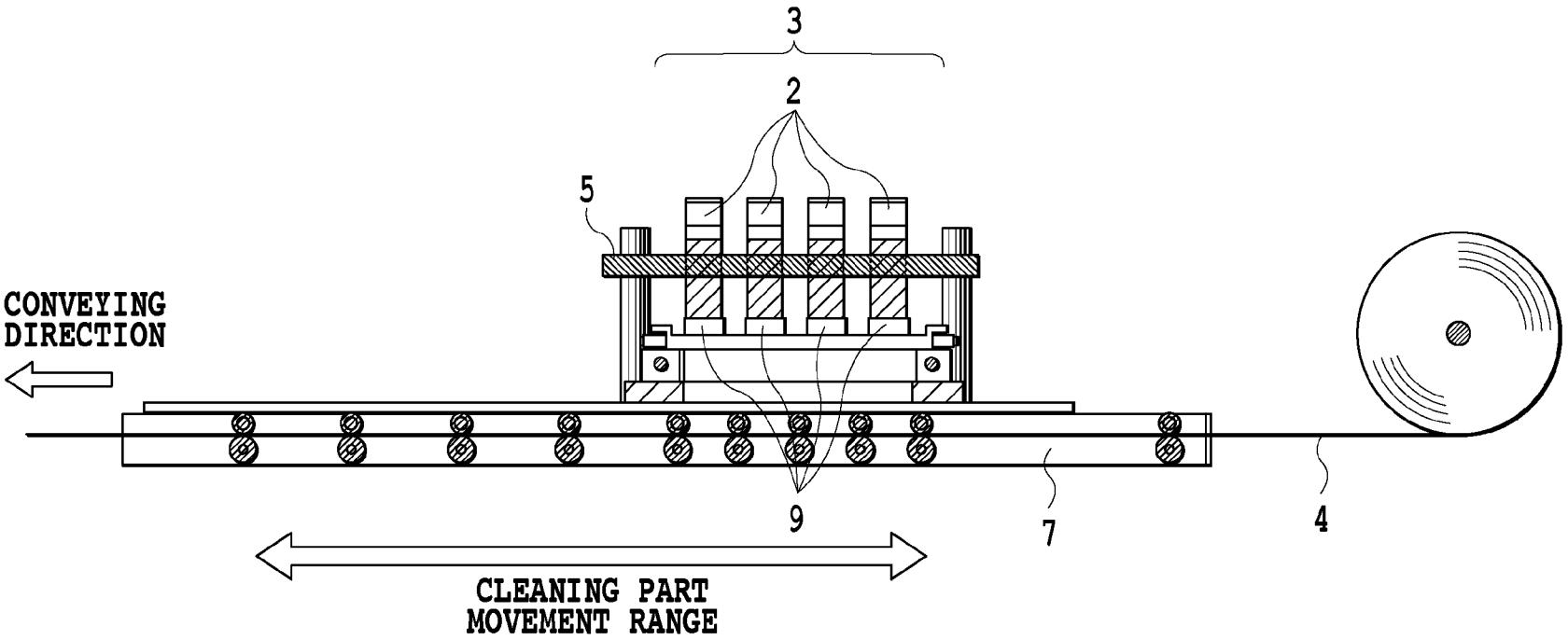
FIG. 3 is another schematic cross-sectional view showing a cross-sectional construction of the printing apparatus of FIG. 1.

FIG. 2 and FIG. 3 are schematic cross-sectional views showing a cross-sectional structure of the printing apparatus of FIG. 1. Downstream of the printing unit 3 there is a cleaning unit 6 which cleans a plurality of ink nozzles 38 formed in the print heads 2 with wiping mechanisms 9. The cleaning unit 6 is movable in a direction in which the print medium is conveyed and, during a cleaning operation, moves directly below the print heads as shown in FIG. 2.

Figure 4:
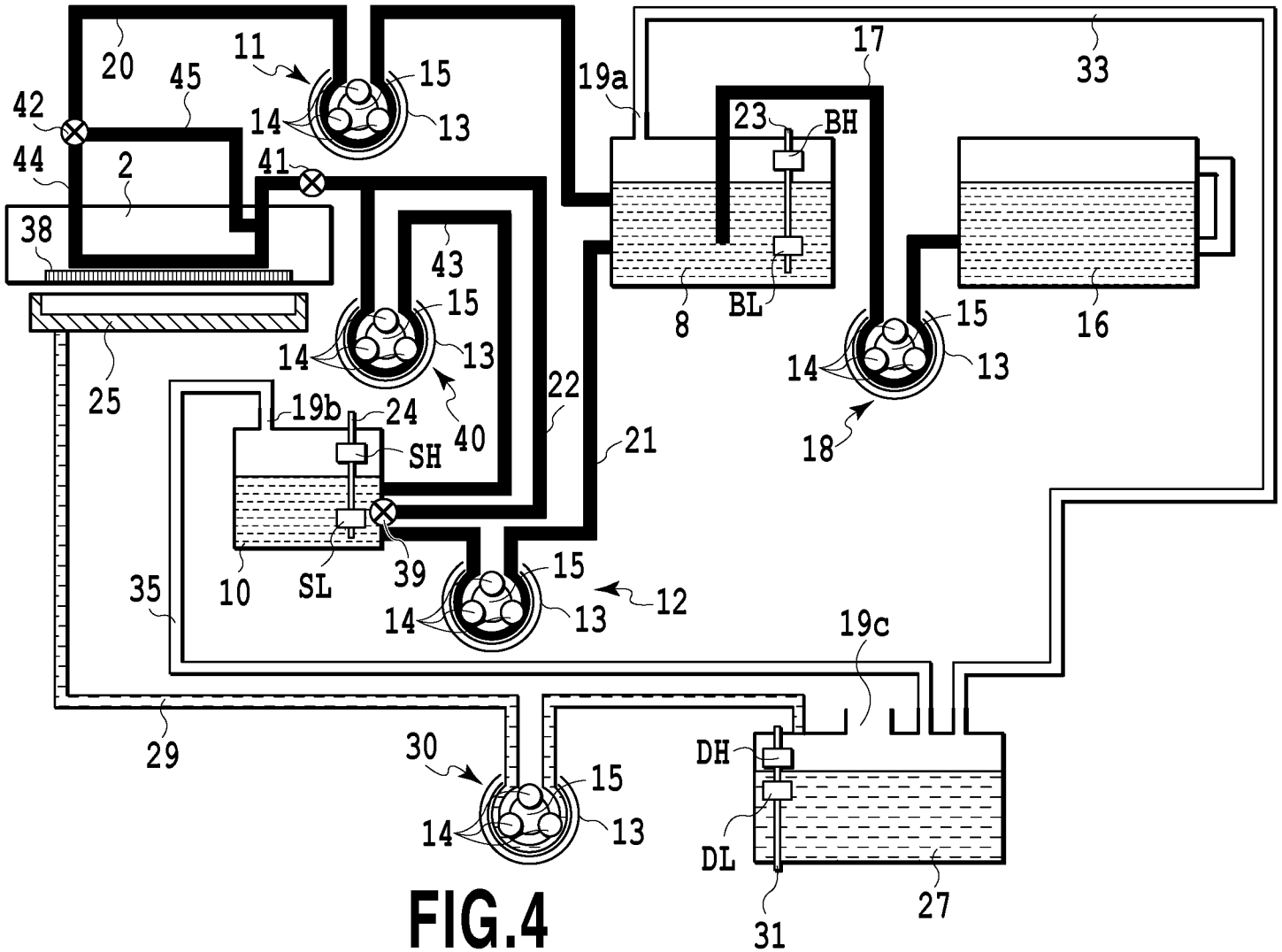
FIG. 4 is a schematic view showing an overall construction of the printing apparatus of this embodiment.
Figure 5:
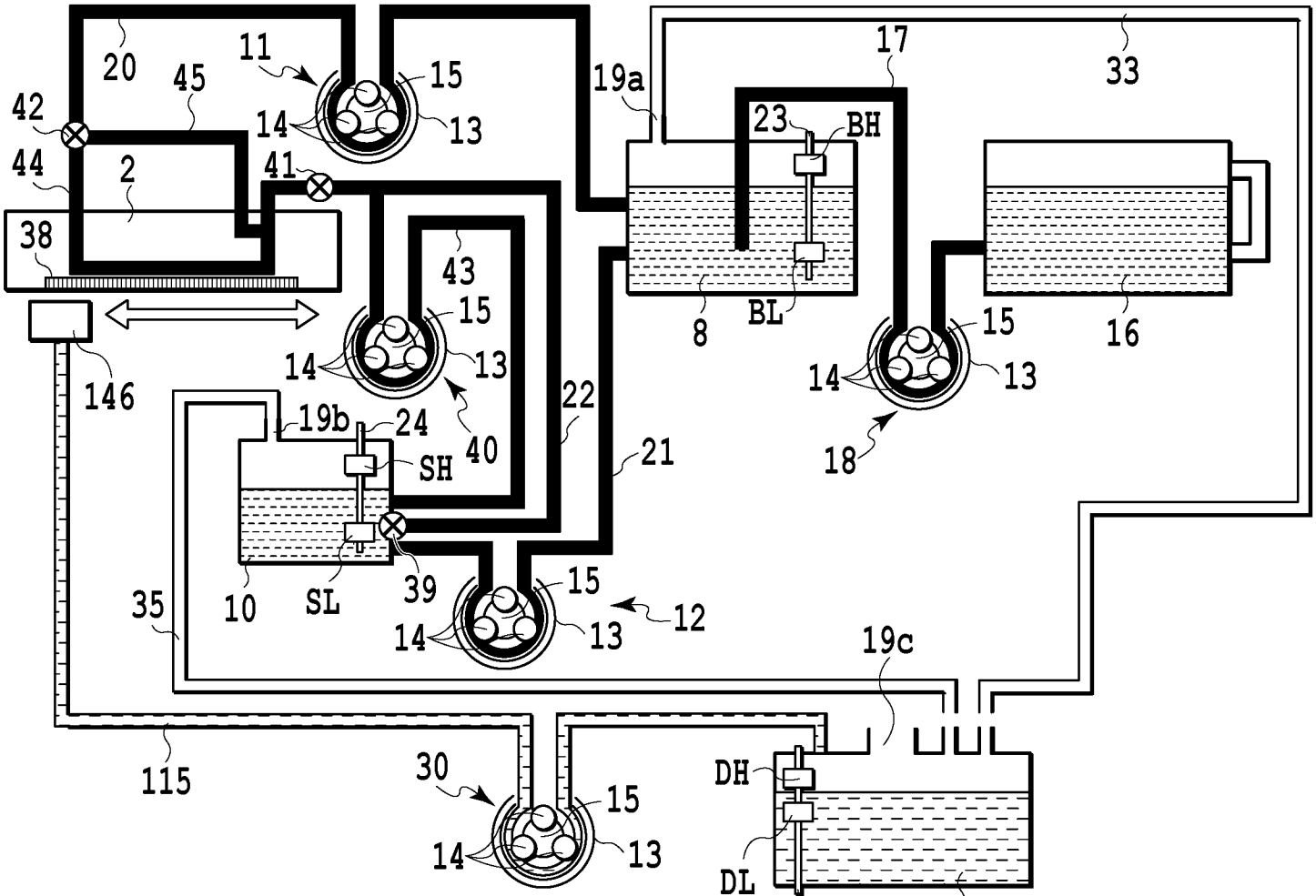
FIG. 5 is another schematic view showing an overall construction of the printing apparatus of this embodiment.

FIG. 4 and FIG. 5 are schematic overall configuration of the printing apparatus of this embodiment. First, a basic configuration of an ink circulation passage in this embodiment will be described. The ink circulation path comprises an ink supply path, an ink recovery path and an ink discharge path. The ink supply path supplies ink from an ink tank to a print head, while the ink recovery path recovers ink from the print head to a buffer tank.

On an outlet side of the print head 2 is provided a buffer tank 8 or a first ink storage portion. Downstream of the buffer tank 8 along the passageway is located a subtank 10 or a second ink storage portion. Further down the passageway from the subtank 10 is installed the print head 2. In this way the ink circulation path is formed.

The print head 2 has an in-head path 44 running therethrough and a bypass path 45 not running through but bypassing the head. Between the print head 2 and the buffer tank 8 is installed a first switch valve 42 for selecting between the in-head path 44 and the bypass path 45 and closing the other. A downstream side of the first switch valve 42 is coupled to a first circulation tube 20, in which a first circulation pump 11 is installed. The buffer tank 8 is connected to the subtank 10 through a second circulation tube 21, in which a second circulation pump 12 is installed. The subtank 10 is connected to the print head 2 via a third circulation tube 22, which is coupled with second and third switch valve 39, 41 at both ends thereof. The first and second circulation pumps 11, 12 are of a tube pump type that can produce a positive or negative pressure by squeezing the tube between a pump guide 13 and pump rollers 14 while driving the pump rollers 14 in a forward or backward direction. These circulation pumps use a motor (not shown), such as a stepping motor, to rotatively drive a pump roller holder 15 that rotatively supports the pump rollers 14 therein.

The first and second circulation pumps are driven simultaneously to circulate ink through the ink circulation path between the buffer tank 8, the subtank 10 and the print head 2. The first switch valve 42 selects either the in-head path 44 or the bypass path 45 for ink circulation. Further, a fourth circulation tube 43 is used to connect the subtank 10 to the print head 2, with a third circulation pump 40 installed in the tube 43.

An ink tank 16 is an ink storage portion for the supply of ink to the printing apparatus 1 and is removably installed in the printing apparatus. The ink supply from the ink tank 16 to the printing apparatus 1 is achieved through a supply tube 17, in which is installed a supply pump 18 that delivers ink to the buffer tank 8, the supply pump 18 being of the same tube pump type as the circulation pumps 11, 12.

The buffer tank 8 and the subtank 10 have air vent ports 19*a*, 19*b* formed in their top portion, respectively, to vent air bubbles accumulated in the tanks out into the atmosphere at all times. The air vent ports thus prevent ink meniscuses formed in the ink nozzles 38 of the print head 2 from being broken by changes in temperature and atmospheric pressure or by pressure changes in the ink tanks during ink circulation through the print head 2, which would otherwise result in ink bleeding from the nozzles and air bubbles infiltrating into the nozzles.

Further, whether the ink circulation operation is performed or not, the subtank 10 is located at a height where a balance is struck between a pressure in the circulation path and a pressure produced by a hydraulic head difference to prevent possible ink bleeding from or air infiltration into the nozzles 38 of the print head 2 even when the head holder 5 holding the print head 2 moves vertically up or down as during the operation mode shift to a printing state or to a capping state.

The buffer tank 8 and the subtank 10 also have liquid level detectors to control the amount of ink accommodated in each tank. The buffer tank 8 has a float sensor 23 or a first liquid level detector to detect an ink level in it. The float sensor 23 has at its upper and lower portions cylindrical floats BH, BL each incorporating a magnet, with a reed switch (not shown) built into a shaft passing through and supporting the floats BH, BL. Each of the floats BH, BL is displaced in the direction of height according to the volume of ink in the tank to turn on or off the built-in reed switch, the state of which is used to determine the remaining ink volume in the tank. The subtank 10, as with the buffer tank 8, has a float sensor 24 or a second liquid level detector. The float sensor 24 has at its upper and lower portions floats SH, SL. Although the aforementioned construction of the float sensors 23, 24 is used in the following description of the embodiment, the liquid level detectors may be constructed otherwise. For example, they may be of an electrostatic capacitance type that checks a difference in electrostatic capacitance for the presence or absence of a liquid in the tank; an ultrasonic type that detects the liquid level by transmitting an ultrasonic wave to a liquid surface, checking if the wave has bounced back and returned and measuring the time it takes for the wave to return to where it originated; or an optical type that determines the presence or absence of a liquid in the tank, by emitting light from a light emitting device and checking whether the emitted light is totally reflected onto a light receiving device. Furthermore, although in this embodiment two liquid levels are to be detected in each tank, the number of liquid levels to be detected may be three or more or may be changed for each tank. It may also be possible to employ a construction that detects a liquid level linearly. As for the means of detecting the ink volume in a tank, there is no need to stick with a method of detecting the liquid level. For example, the ink volume may be determined by using a means which checks a change in liquid weight as by a weight sensor to detect a change in the liquid volume in the tank.

Next, the basic construction of the ink discharge path in this embodiment will be described. The cleaning unit 6 has a cap 25 which, when the printing apparatus is not in a printing operation, hermetically seals the ink nozzles 38 to prevent possible ink ejection failures. The cap 25 is connected to a drain tank 27, a waste ink collector removably installed in the printing apparatus 1, which forms a part of the ink discharge path. Since what the drain tank 27 collects is waste inks, no problem arises if different color inks mix together and therefore only one common drain tank needs to be provided for all color inks. But if space allows, a plurality of drain tanks may be used, one for each color.

A coupling portion between the printing apparatus 1 and the drain tank 27 has a valve mechanism (not shown). With the drain tank 27 installed in the printing apparatus 1, the valve mechanism (not shown) is open, allowing the cap 25 to communicate with the drain tank 27. When the drain tank 27 is taken out of the printing apparatus 1, the valve mechanism (not shown) is closed, hermetically sealing the coupling portion of the drain tank 27 to prevent ink leakage. The cap 25 and the drain tank 27 are interconnected through a discharge tube 29, in which a discharge pump 30, of a tube pump type similar to the circulation pumps 11, 12 and the supply pump 18, is installed. In this construction of the ink discharge path, waste ink expelled from a plurality of ink nozzles 38 of the print head 2 (as during a cleaning ejection performed between printing operations) is received in the cap 25. The waste ink in the cap 25 is then discharged into the drain tank 27 by driving the discharge pump 30 with a drive source not shown. The drain tank 27 is provided with a float sensor 31 or a third liquid level detector, as in the buffer tank 8 and subtank 10. The float sensor 31 has floats DH, DL at the upper and lower portions thereof. Like other float sensors 23, 24, this liquid level detector 31 is not limited to this construction.

Figure 6:
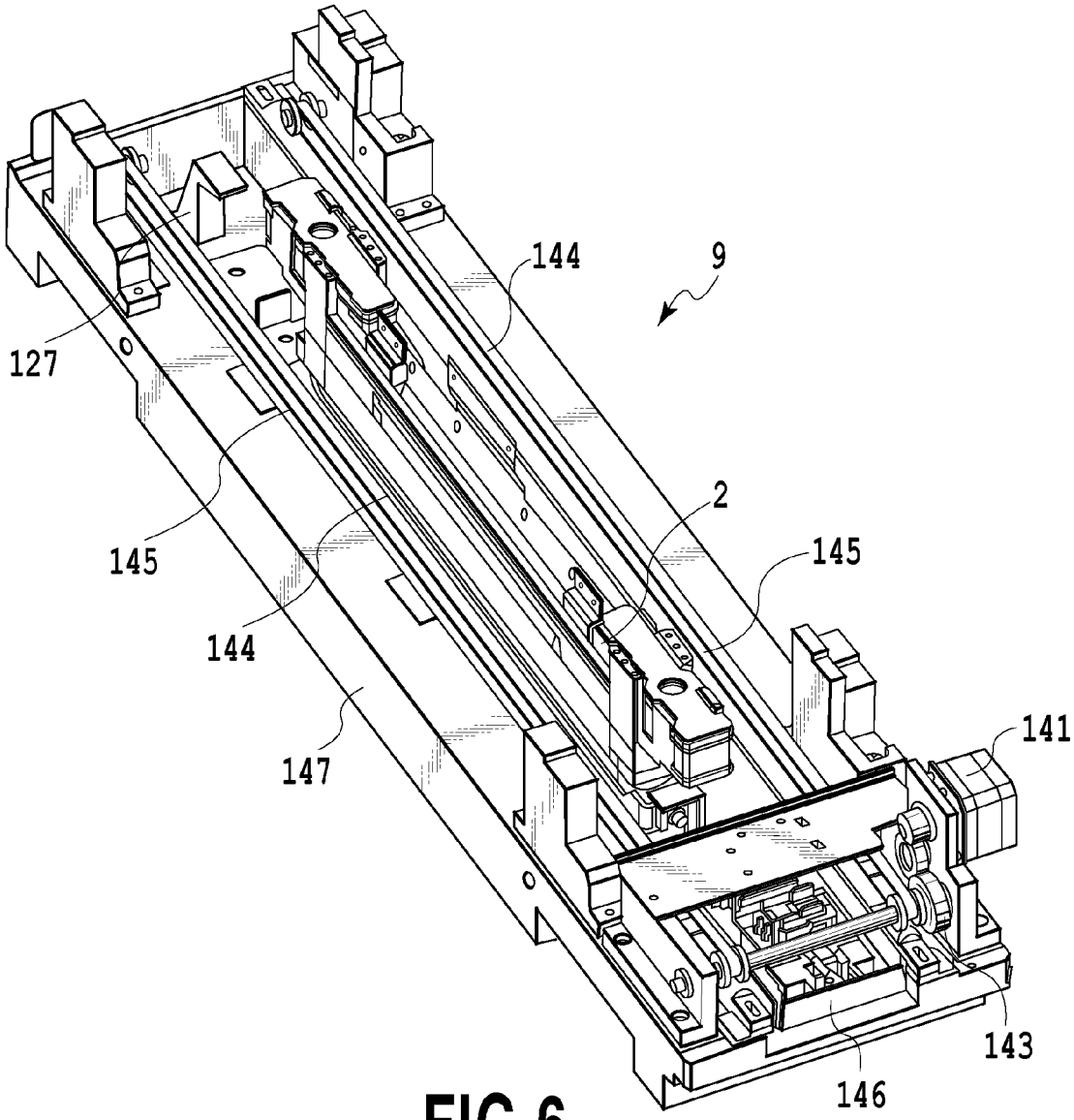
FIG. 6 is a perspective view showing a detailed construction of a cleaning unit and a cleaning mechanism in this embodiment.
Figure 7:
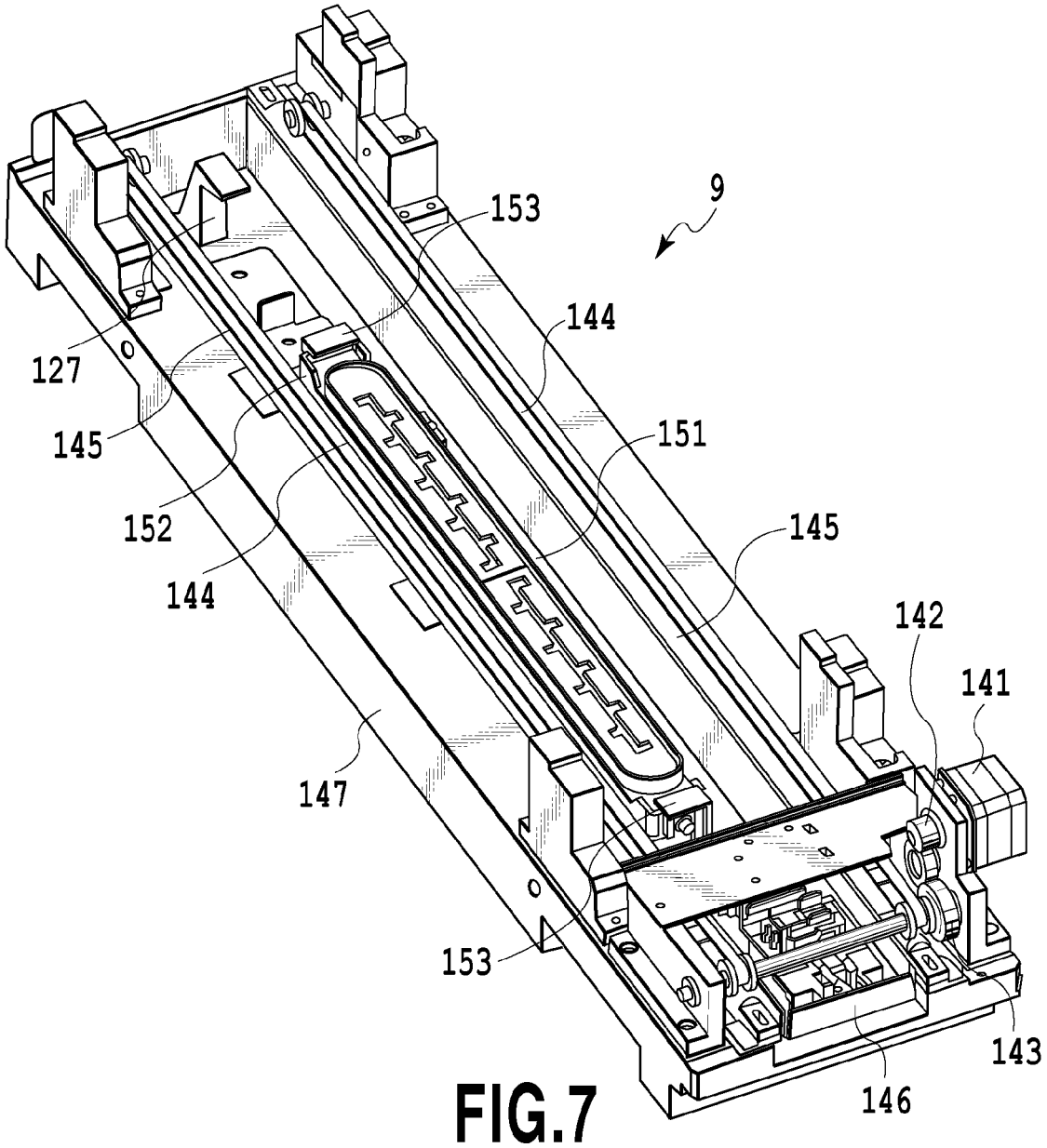
FIG. 7 is another perspective view showing a detailed construction of the cleaning unit and the cleaning mechanism in this embodiment.

FIG. 6 and FIG. 7 are perspective views showing a detailed construction of the cleaning unit 6 and one cleaning mechanism 9. FIG. 6 shows a state in which the cleaning mechanism is below the print head (cleaning state) while FIG. 7 shows a state in which the cleaning mechanism is not below the print head.

The cleaning mechanism 9 has a wiper unit 146 for wiping ink and dirt off a nozzle-formed surface of the print head 2, a moving mechanism for moving the wiper unit 146 in a wiping direction (second direction) and a frame 147 that supports the wiper unit 146 and the moving mechanism in their place. The wiper unit 146 is one movable unit formed with blades and suction ports. The moving mechanism is powered by a drive source to move the wiper unit 146 in the second direction as it is guided and supported on two shafts 145. The drive source has a drive motor 141 and reduction gears 142, 143 to rotate a drive shaft 137. The wiper unit 146 removes ink and dirt from the nozzle-formed surface of the print head 2 by a combination of the blades and the suction ports. Outside a wiping area of the frame 147 is provided a trigger lever 127 that switches the direction of blades 121.

In FIG. 7 the cap 25 is held in a cap holder 152. The cap holder 152 is urged perpendicularly to the nozzle-formed surface of the print head 2 by an elastic spring and can be pushed back against the force of the spring. With the frame 147 of the cleaning mechanism 9 located at a capping position, the print head 2 is lowered or raised vertically to bring its nozzle-formed surface into or out of intimate contact with the cap 25. Hermetically capping the nozzle-formed surface can minimize the drying of the nozzles.

Figure 8:
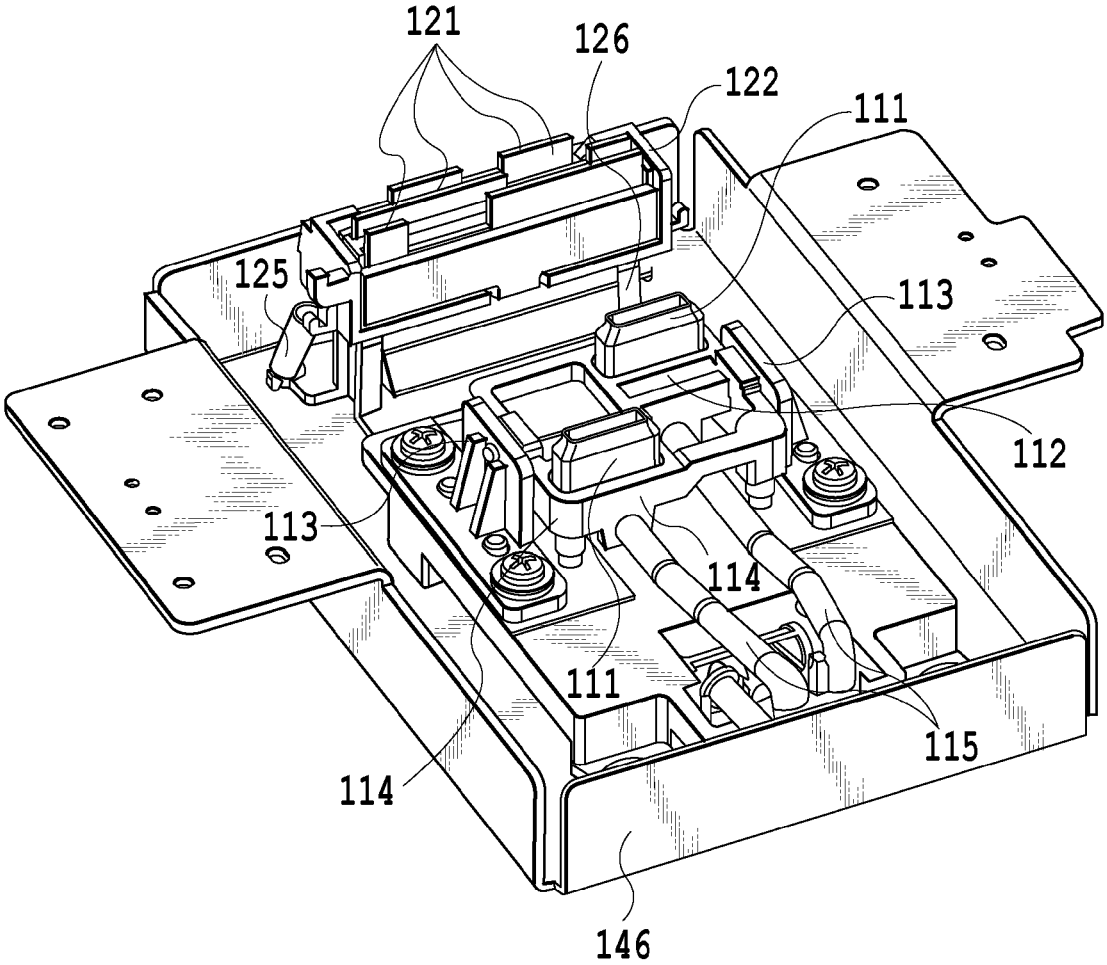
FIG. 8 is a perspective view showing a wiper unit in this embodiment.

FIG. 8 shows the construction of the wiper unit 146 in this embodiment. The wiper unit 146 has two suction ports 111 (first and second suction means) corresponding to a first and a second nozzle array in the print head. The suction ports 111 are held in a suction port holder 112, which is urged by an elastic spring 114 in a direction (third direction) perpendicular to the nozzle-formed surface of the print head 2 so that the suction port holder 112 can be moved in the third direction against the force of the spring. That is, the suction port holder 112 is supported by a displacement mechanism with the elastic spring that allows the suction port holder to be displaced in a direction of distance between the nozzle-formed surface and the print medium (third direction).

The two suction ports 111 are coupled through the suction port holder 112 to tubes 115 that are connected with a negative pressure generation device, such as a suction pump. The negative pressure generation device, when activated, produces a negative pressure in the suction ports 111 that sucks out ink or dirt from the nozzles. The blades 121 are held in a blade holder 122. The blade holder 122 is rotatably supported at both ends thereof that are separated along its first-direction rotary axis. The height of top edges of the blades 121 can be changed between a wiping position and a retracted position by a height selector mechanism. The suction port holder 112 and the blade holder 122 are mounted on a common support body of the wiper unit 146.

Figure 9A:
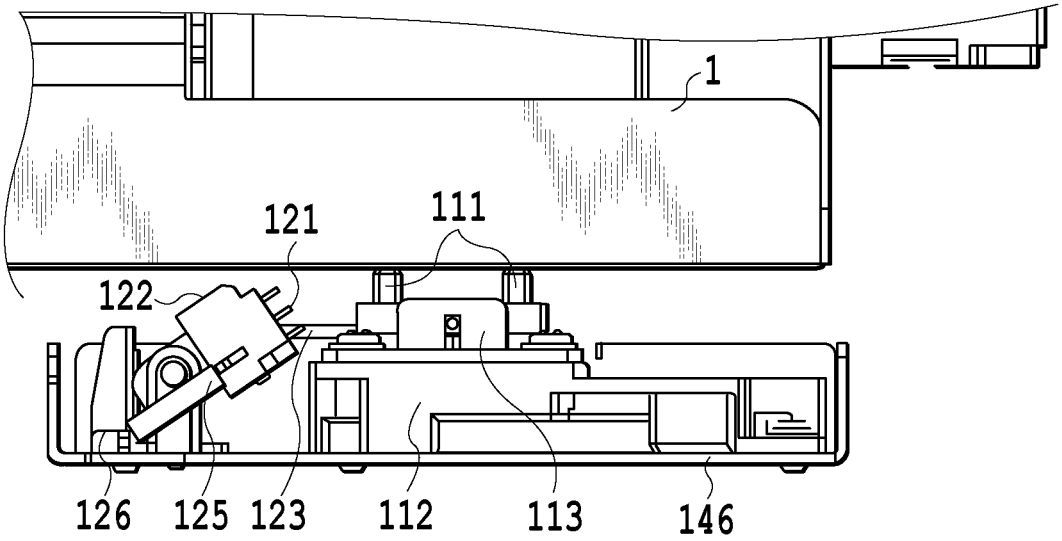
FIGS. 9A and 9B are side views showing the cleaning mechanism in this embodiment.
Figure 9B:
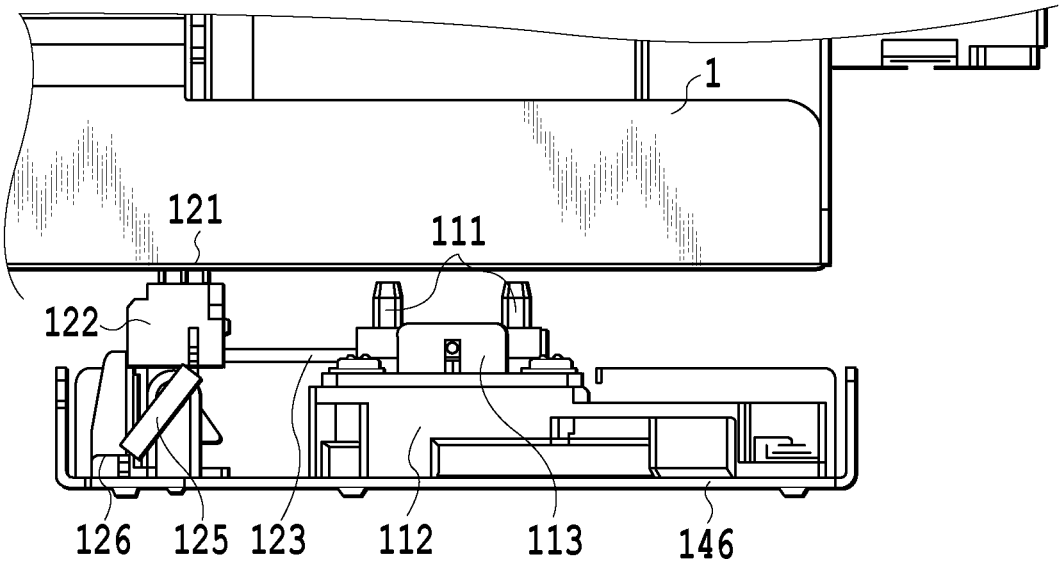

FIG. 9A and FIG. 9B are side views of the cleaning mechanism of the embodiment. FIG. 9A shows a state of a suction mode in which the suction ports 111 are sucking the print head 2 and FIG. 9B shows a state of a wiping mode in which the blades 121 are wiping the print head 2 clean.

During the suction mode, the blades 121 are moved to the retracted position, as shown in FIG. 9A. In this state, the top edges of the blades 121 are set at a greater distance from the nozzle-formed surface of the print head 2 than the tips of the suction ports 111 are. The print head 2 is moved to and held at a position (suction mode position) in the third direction so that the tips of the suction ports 111 are kept in contact with the nozzle-formed surface of the print head 2. When, in this state, the negative pressure generation device is activated to produce a negative pressure in the suction ports 111 as the wiper unit 146 is moved in the second direction, ink and dirt adhering to the nozzles can be sucked out of the nozzles into the suction ports 111.

During the wiping mode, on the other hand, the blades 121 are moved to the wiping position, as shown in FIG. 9B. The print head 2 is moved to and held at an appropriate position (wiping mode position) in the third direction so that the top edges of the blades 121 properly contact the nozzle-formed surface of the print head 2. At this state, the tips of the suction ports 111 are at a greater distance from the nozzle-formed surface of the print head than they were during the suction mode in FIG. 9A. The negative pressure means is stopped. As the wiper unit 146 is moved, the blades 121 wipe the nozzle-formed surface clean, removing ink and dirt from it.

As described above, the cleaning mechanism has two modes—suction mode and wiping mode—and can selectively perform one of the modes, using the same wiper unit 146. For example, if it is decided that there are no faulty nozzles that fail to eject ink properly, the wiping mode is selected, which allows the nozzle-formed surface of the print head to be cleaned without consuming ink from the nozzles at all. If it is decided that there are some improperly ejecting nozzles, the suction mode is selected, in which the suction ports 111 suck ink and dirt from the nozzles and the nozzle-formed surface, allowing the nozzles to be cleaned while minimizing the ink consumption from the nozzles.

Next, we will explain a preparatory procedure to be performed in the embodiment before the print head is replaced.

Figure 10:
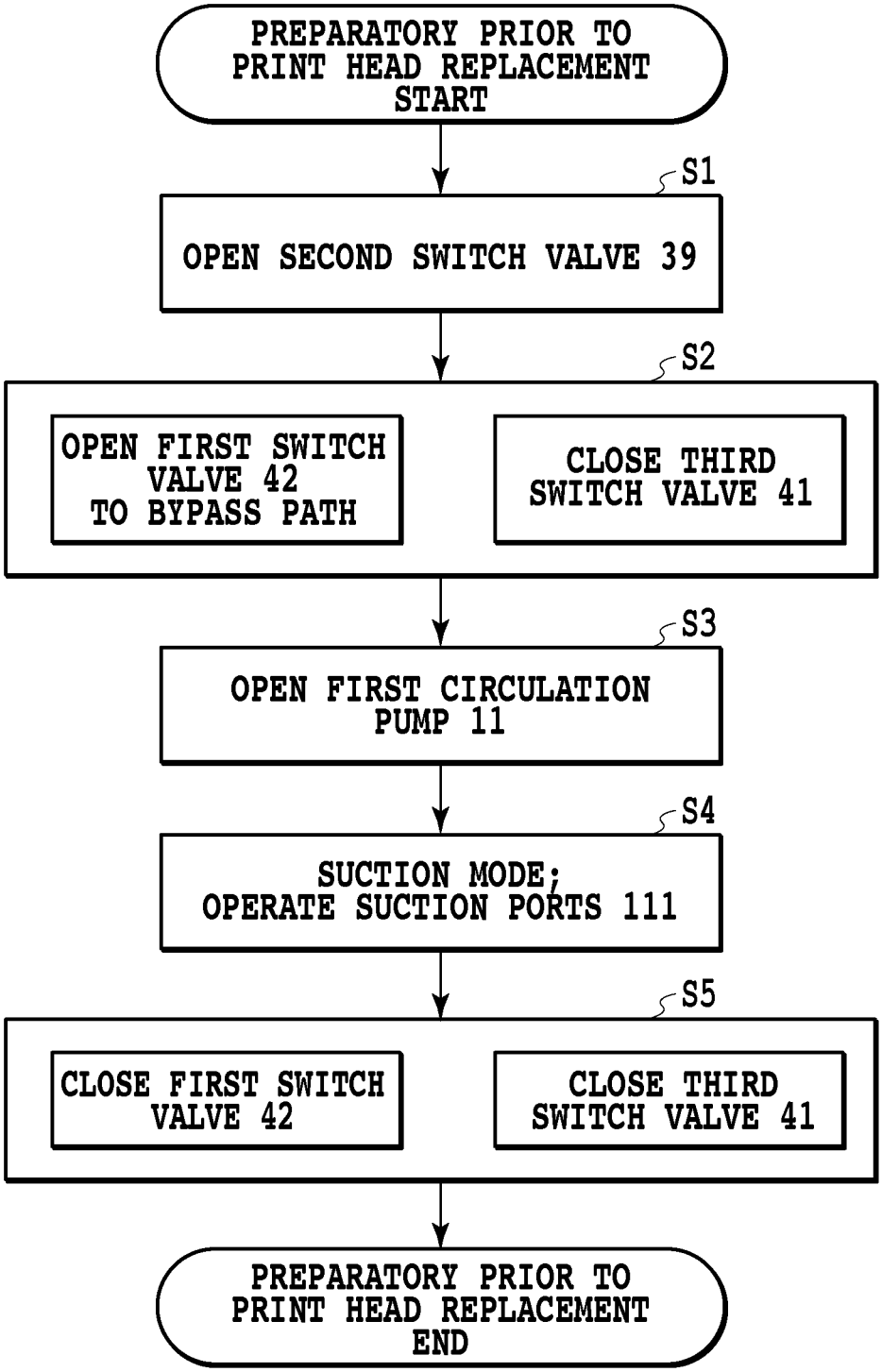
FIG. 10 is a flow chart showing a preparatory procedure performed prior to a replacement of a print head in this embodiment.

FIG. 10 is a flow chart showing a preparatory procedure that needs to be done in the embodiment before the print head can be replaced.

When the preparatory procedure prior to the print head replacement is started, the second switch valve 39 is opened (step S1). Then, the first switch valve 42 is operated to select and open the bypass path 45 and the third switch valve 41 is closed (step S2). In this state, the first circulation pump 11 is operated to move ink from the in-head path 44, the bypass path 45 and the first circulation tube 20 into the buffer tank 8 (step S3). These steps, when finished, brake ink meniscuses in the ink nozzles 38, bringing the ink nozzles 38 into communication with atmosphere. After the operation of the first circulation pump 11 is finished, the wiper unit 146 is operated in the suction mode (step S4). In this operation the suction ports 111 of the wiper unit suck out ink from the nozzle liquid chamber and ink adhering to the nozzle-formed surface of the print head. Next, the first switch valve 42 and the third switch valve 41 are closed (step S5). With these steps taken, ink can be prevented from leaking from the nozzles when the print head 2 is removed during the print head replacement work. Further, this preparatory procedure can also prevent the ink in the circulation path from leaking, due to hydraulic head difference, from a joint not shown that opens to an atmosphere when the print head is removed. This enhances the ease with which the print head can be replaced.

With the aforementioned preparatory procedure for the print head replacement complete, a user takes out the used print head 2 from the printing apparatus 1 and installs in its place a new print head 2 filled with a shipping ink.

Next, a process of discharging a shipping ink after the replacement of the print head 2 in the embodiment will be explained.

Figure 11:
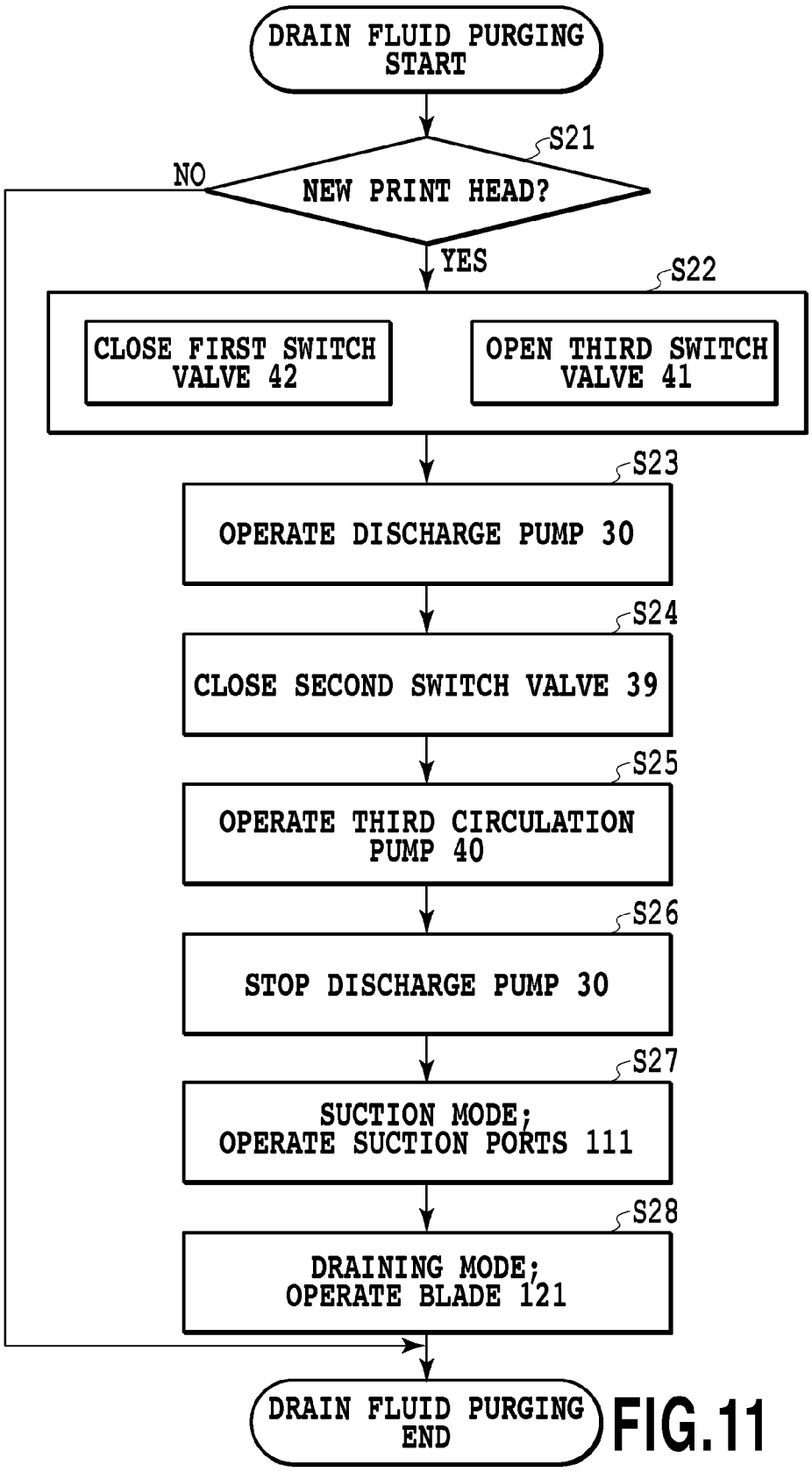
FIG. 11 is a flow chart showing an operation to remove a shipping ink from the print head in this embodiment.

FIG. 11 is a flow chart showing a sequence of steps executed to expel a shipping ink from a new print head following the print head replacement in this embodiment. The shipping ink is a liquid to be loaded into print heads before they are stored for a long period or shipped out If during a long period of storage a print head is left not filled with some kind of protective ink, heaters in the print head may be contaminated. If, after the storage, the print head is used as is, the heaters are likely to exhibit a degraded ink bubble formation performance in a printing operation, resulting in ink droplets failing to land at correct positions. To prevent such a problem, the print head is filled with a shipping ink before the print head is placed in a long-term storage or in a goods distribution system. The shipping ink in this embodiment is a colorless, highly viscous liquid but the invention is not limited to the use of such a shipping ink. That is, the shipping ink may be any other liquid as long as it does not produce adverse effects on the print head performance after a long period of storage of the print head filled with the liquid. If this requirement is met, the shipping ink may be low in viscosity.

First, a check is made as to whether the print head 2 newly mounted in the print head 1 is a new one, by referencing ID information of a print head unit (step S21). If the print head 2 is determined not to be a new one, the shipping ink is already expelled from the print head 2. So, an operation to discharge the print head of the shipping ink is skipped, ending the shipping ink discharging operation. If, on the other hand, the print head 2 is determined to be a new one, the first switch valve 42 is closed and the third switch valve 41 is opened (step S22). In this state, the discharge pump 30 is started to bring the cap 25 into and hold it in a suction state (step S23). Next, the second switch valve 39 is closed (step S24) and the third circulation pump 40 is operated to force a printing ink from the subtank 10 through the fourth circulation tube 43 into the print head 2, pressurizing the interior of the print head 2, which in turn forces the shipping ink out of the ink nozzles 38 (step S25). At this time, the shipping ink discharged from the ink nozzles 38 falls into the depressurized cap 25, from which it is delivered by the discharge pump 30 to the drain tank 27. After the third circulation pump 40 is stopped, the discharge pump 30 is kept in operation until the ink remaining in the cap 25 is fully discharged, after which the discharge pump 30 is stopped (step S26). Then, the wiper unit 146 is operated in the suction mode to cause the suction ports 111 to suck out the remaining shipping ink from the nozzle liquid chamber and from the nozzle-formed surface of the print head (step S27). As a final step, the wiper unit 146 is operated in the wiping mode to cause the blades 121 to wipe the nozzle-formed surface to clear it of ink and dirt (step S28).

Next, after the shipping ink has been discharged from the print head in the embodiment, a process of filling the print head 2 with a printing ink will be described.

Figure 12:
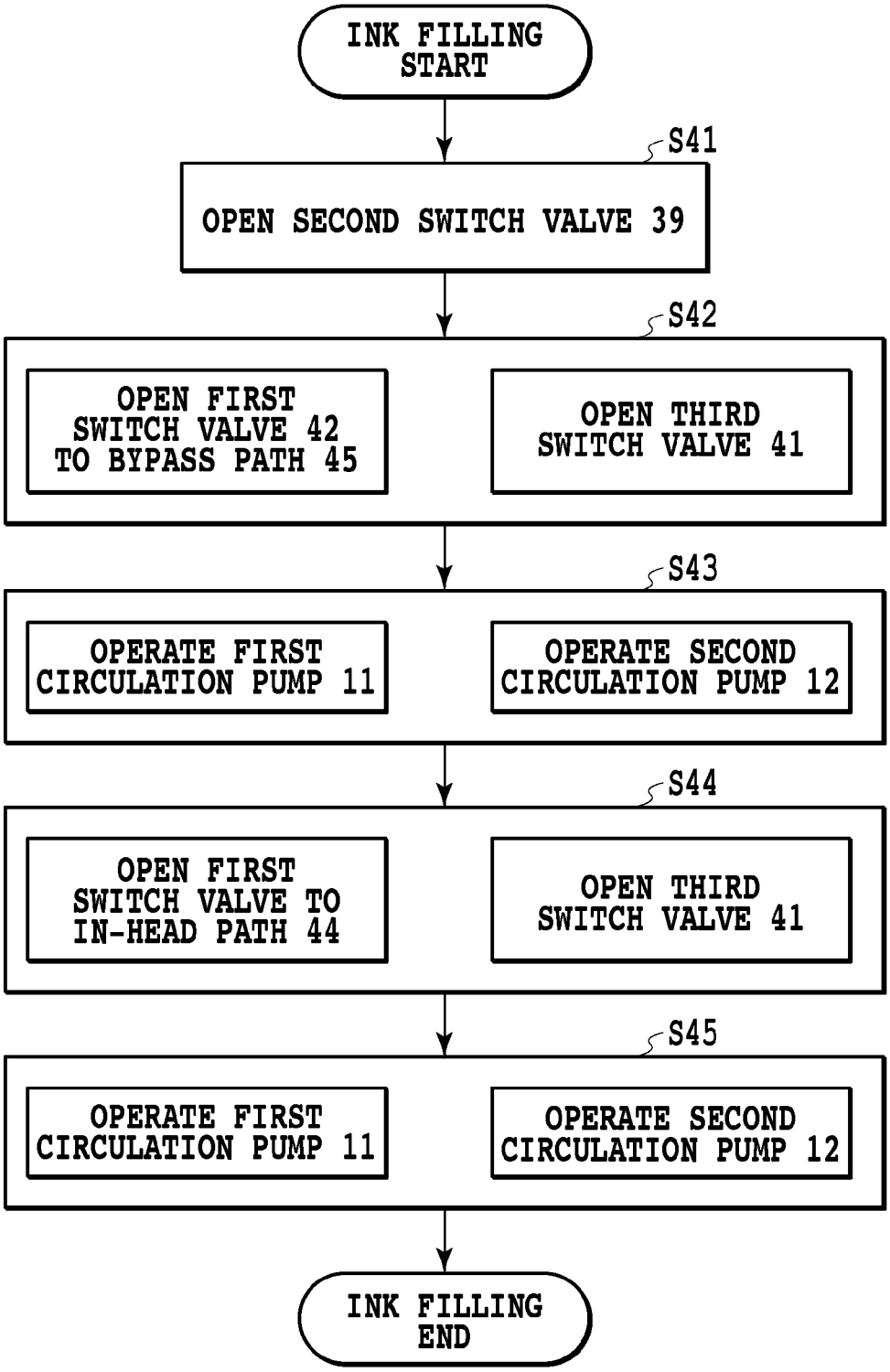
FIG. 12 is a flow chart showing an operation to fill an ink into the print head in this embodiment.

FIG. 12 is a flow chart showing a process of loading an ink into the print head 2 after the print head has been discharged of the shipping ink. First, the second switch valve 39 is opened (step S41). Then, the first switch valve 42 is operated to select and open into the bypass path 45 and the third switch valve 41 is left open (step S42). In this state, the first circulation pump 11 and the second circulation pump 12 are operated simultaneously to cause the ink to circulate through an ink circulation path that runs through the print head 2 (bypass path 45), the first circulation tube 20, the buffer tank 8, the second circulation tube 21, the subtank 10 and the third circulation tube 22 in that order (step S43). This operation moves air and bubbles, trapped in the ink circulation path during the replacement of the print head 2, to the buffer tank 8, from which they are released through the air vent port 19*a* out into the atmosphere. After the air and bubbles have been completely discharged from the ink circulation path, the first switch valve 42 is operated to select and open into the in-head path 44 and the third switch valve 41 is left open (step S44). Then the first circulation pump 11 and the second circulation pump 12 are operated at the same time to cause the ink to circulate through an ink circulation path that runs through the print head 2 (in-head path 44), the first circulation tube 20, the buffer tank 8, the second circulation tube 21, the subtank 10 and the third circulation tube 22 in that order. As a result, the print head 2 is filled with the ink (step S45). Since the ink circulation path has already been discharged of air and bubbles, the in-head path 44 can be filled with ink without air entering therein.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-231276 filed Oct. 21, 2011, which is hereby incorporated by reference herein in its entirety.

What is claimed is:

1. An inkjet printing apparatus comprising:

a print head having a plurality of nozzles for ejecting ink;

an ink tank accommodating ink to be supplied to the print head;

a first pump installed in an ink supply path to supply ink from the ink tank to the print head;

a second pump installed in an ink collect path to collect ink not ejected from the print head to the ink tank;

a first path provided between the ink supply path and the ink collect path and configured to supply ink to the plurality of nozzles;

a second path provided between the ink supply path and the ink collect path and configured to bypass the first path;

a switch unit installed between the print head and the second pump, and configured to switch between a first state where neither the first path nor the second path is in communication with the ink collect path, a second state where the first path is in communication with the ink collect path, and a third state where the second path is in communication with the ink collect path;

a cleaning unit to clean the print head; and a control unit configured to control the first pump, the second pump, the switch unit and the cleaning unit, wherein, when a print head filled with shipping ink is installed in the inkjet printing apparatus, the control unit is configured to (i) operate the first pump to discharge the shipping ink from the nozzles as the switch unit is in the first state, (ii) operate the cleaning unit to clean the print head, (iii) operate the second pump to supply ink from the ink tank as the switch unit is in the third state, and (iv) operate the second pump to supply ink from the ink tank to the print head as the switch unit is in the second state.

2. An inkjet printing apparatus according to claim 1, wherein the cleaning unit comprises:

a waste ink recovery unit;

a cap arranged below a nozzle-formed surface of the print head; and a negative pressure generation device, wherein, the control unit is configured to control the cleaning unit to receive the shipping ink discharged from the print head and transfer the shipping ink from the cap to the waste ink recovery unit by a negative pressure generated by the negative pressure generation device.

3. An inkjet printing apparatus according to claim 1, further comprising a switch valve installed in the ink supply path, wherein, before replacement of the print head from the inkjet printing apparatus, the control unit is configured to operate the second pump in a state that the switch valve is closed.

4. An inkjet printing apparatus according to claim 1, wherein the cleaning unit comprises:

a suction device for sucking ink from at least a part of the nozzles, and a blade for wiping the nozzles.

5. An inkjet printing apparatus according to claim 3, wherein before the replacement of the print head from the inkjet printing apparatus, the control unit is configured to operate the second pump as the switch unit is in the third state and the switch valve is closed.

* * * * *